US006101364A

United States Patent [19]

Boehmer et al.

[11] Patent Number: 6,101,364

[45] Date of Patent: Aug. 8, 2000

[54] PRINTER OR COPIER WITH TWO PRINTING UNITS AND A METHOD FOR THE OPERATION THEREOF

[75] Inventors: Georg Boehmer, Munich; Joseph Dietl; Hans Hahn, both of Unterhaching; Bernward Heller, Kirchheim; Hubert Mugrauer, Zorneding; Otto Olbrich, Taufkirchen; Reinhold Rigauer; Otto Rotheimer, both of Erding; Rudolf Seeberger, Lochham, all of Germany

[73] Assignee: Océ Printing Systems GmbH, Poing, Germany

[21] Appl. No.: 09/284,918

[22] PCT Filed: Oct. 22, 1997

[86] PCT No.: PCT/DE97/02466

§ 371 Date: Jun. 4, 1999

§ 102(e) Date: Jun. 4, 1999

[87] PCT Pub. No.: WO98/18054

PCT Pub. Date: Apr. 30, 1998

[30] Foreign Application Priority Data

Oct. 22, 1996 [DE] Germany ..... 196 43 635

[51] Int. Cl.[7] ..... G03G 15/00

[52] U.S. Cl. ..... 399/361; 271/186; 271/301; 399/16; 399/364; 399/381

[58] Field of Search ..... 399/361, 16, 18, 399/364, 401, 107; 271/185, 186, 225, 291, 301, 902

[56] References Cited

U.S. PATENT DOCUMENTS

| | | | |
|---|---|---|---|
| 4,587,532 | 5/1986 | Asano | 346/134 |
| 4,591,884 | 5/1986 | Miyamoto et al. | 399/374 X |
| 4,972,236 | 11/1990 | Hasegawa | 399/16 |
| 5,150,167 | 9/1992 | Gonda et al. | 399/16 |
| 5,208,640 | 5/1993 | Horie et al. | 271/301 X |
| 5,598,257 | 1/1997 | Keller et al. | 399/364 |

FOREIGN PATENT DOCUMENTS

| | | |
|---|---|---|
| 32 07 578 A1 | 3/1982 | Germany . |
| 34 07 847 A1 | 3/1984 | Germany . |
| 34 22 942 A1 | 6/1984 | Germany . |
| WO 91/13386 | 9/1991 | WIPO . |

*Primary Examiner*—William Royer
*Assistant Examiner*—Sophia S. Chen
*Attorney, Agent, or Firm*—Hill & Simpson

[57] ABSTRACT

A method for operating a printer or copier is disclosed. The method includes the following steps: supplying sheet-shaped material individually in succession through an input section to a first printing unit; printing an image pattern onto a sheet-shaped material with the first printing unit; sending the printed sheet-shaped material individually in succession from the first printing unit through an output section; supplying sheet-shaped material individually in succession through the input section to a second printing unit; printing an image onto the sheet-shaped material with the second printing unit; sending the printed sheet-shaped material individually in succession from the second printing unit through the output section; and in a simplex operating mode, alternating the supplying of sheet-shaped material to the first and second printing units by switching a first shunt disposed in the input section; and in a duplex operating mode, supplying printed sheet-shaped material, with printing disposed on a first side thereof, from the first printing unit through a first transfer printing transport path to a connecting channel to the second printer for printing transport path to the second printing unit for printing a second side of the printed sheet-shaped material; and in an emergency operating mode, wherein one of the first or second printing units is malfunctioning, shutting off the malfunctioning printing unit and switching the first shunt to supply sheet-shaped material only to the non-malfunctioning printing unit.

36 Claims, 7 Drawing Sheets

PRINTER OR COPIER WITH TWO PRINTING UNITS AND A METHOD FOR THE OPERATION THEREOF

FIELD OF THE INVENTION

The invention is directed to a method for the operation of a printer or copier, whereby sheet-shaped material is individually successively supplied via an input section to a first electrographic printing unit that prints an image on a sheet-shaped material, and whereby the printed material is individually successively output via an output section.

BACKGROUND OF THE INVENTION

Given a known high-performance printer having only a single printing unit, the individual printer components are exactly matched to one another, so that a very reliable operating condition with high printing output is achieved. In order to increase the printing output even farther, structural modifications must be undertaken at these components, this leading to a high development outlay and raising the outage probability due to the redesign of the individual components.

U.S. Pat. No. 4,587,532 discloses a printer that has three printing units that print single sheets in common or alternation arranged above one another. The paper delivery contains shunts in order to supply the single sheets to the various printing units.

DE 34 22 942 A1 discloses a printing system that has two electrophotographic printing stations. Given occurrence of a malfunction in one printing station, the appertaining printing station is shut off, whereby the other printing stations continues operating.

WO 91/13386 discloses a modularly constructed printer means that contains two printing modules. The printing modules can operate in simplex mode, whereby single sheets are supplied to both printing modules via shunts. Further, a duplex mode is possible, whereby the single sheets are first supplied to the one printing module for printing with a first print image; subsequently, a further print image can be applied with the second printing module. The printing modules are designed as separate structural units for installation in a single housing.

DE 34 07 847 A1 discloses an image recording means with multiple functions. Functions such as, for example, high-speed recording, two-side recording and multiplex recording are possible. The printer system contains two printing units that are connectable to one another via a paper guidance system. The paper guidance system also enables the single sheets to be turned over, so that a duplex mode with printing on both sides is possible.

U.S. Pat. No. 4,972,236, further, discloses an image generating system having a plurality of printing units that are arranged vertically over one another in order to save space. In one exemplary embodiment, the paper transports for both printing units are connected to one another by a connecting channel.

U.S. Pat. No. 5,150,167 A discloses a printing system that contains essentially identically constructed printing units. Each of the printing units has a separate input section allocated to it via which sheet material is supplied to the respective printing unit. Given outage of one of the printing units, for example given a paper jam within the transfer printing zone of a printing unit, the second printing unit must be served by the appertaining paper input compartment. What is disadvantageous given this arrangement is that two input compartments must be provided in order to maintain the operational readiness of the apparatus given the outage of a printing unit. When, for example, the lower printing unit goes down because of a paper jam and when the appertaining input compartment in the upper printing unit is empty, then the printer arrangement is entirely out of service.

U.S. Pat. No. 4,591,884 A and U.S. Pat. No. 5,208,640 A disclose a number of printing unit versions. However, a multi-functional arrangement such that both a simplex operating mode with high throughput as well as a duplex operating mode wherein two printing units are employed and an emergency mode given outage of one of the two printing units is not provided.

Therefore, there is a need for a method for the operation of a printer or of a copier that enables a high printing output or, respectively, copier output and works dependably.

SUMMARY OF THE INVENTION

The aforenoted need is satisfied by the present invention, wherein two essentially identically constructed printing units are employed. The components for these printing units, for example the electronic drive, the developing units, the toner delivery and elimination mechanisms, etc., can be retained nearly unmodified. Viewed in and of itself, each printing unit thus has an extremely high operating dependability. Both printing units use a common input section via which the sheet-shaped material is supplied. Likewise, both printing units share an output section for discharging the printed, sheet-shaped material. As a result thereof, the new apparatus is very compactly constructed and can be manufactured with little outlay. The printing output is noticeably increased due to the two printing units.

Given a malfunctioning first printing unit or given a malfunctioning second printing unit, the malfunctioning printing unit is shut off according to the invention, whereby the first shunt then supplies sheet-shaped material only to the non-malfunctioning printing unit. Printing operations can thus still be maintained with the assistance of the non-malfunctioning printing unit, so that printing jobs can be processed until the repair service arrives.

In what is referred to as simplex mode, wherein sheet-shaped material is supplied to the input section with double the transfer printing speed given undisturbed operation, the delivery given a malfunctioning printing unit can only ensue at half speed compared to normal operation. Nonetheless, a considerable advantage is established in this version of the invention since the user of the printing system can continue to work with reduced performance.

In duplex mode, wherein both sides of the single sheets are printed, work can also continue to be carried out given outage of one printing unit. The conveying path in the printer is then set such that the undisturbed printing unit first prints one side, the single sheets are then turned over and resupplied to the same printing unit in order to print the second side.

A redundant operation can thus be built up by employing two printing units in a single printer system or copier system. As a result of this redundancy mode, the down probability of the entire printer system or copier system is substantially reduced. According to the rules of stochastics, the function probability in redundant systems wherein at least one of the two printing units is fully functional—regardless of which—is defined as follows:

$$Pred.=P1\times(1-P2)\times 2+P1\times P2,$$

wherein Pred. is the function probability of the overall printer system or copier system, P1 is the function probability of the first printing unit and P2 is the function probability of the second printing unit.

When one assumes a function probability of, for example, 90% for each printing unit, then the function probability for a redundantly limited operation rises to 99% according to this equation. As mentioned, the printing output is in fact reduced given outage of a printing unit, but the complete outage of the printer system or copier system is avoided with extremely high probability, which means a high dependability for the user for the implementation of his jobs.

One embodiment of the invention provides that the input section contains a shunt that supplies sheet-shaped material either to the first transfer printing transport path or to the second transfer printing transport path. In this embodiment, the operating mode of simplex printing is realized with one color, i.e. supplied sheet-shaped material, for example single sheets of paper, are printed on one side by the first printing unit or by the second printing unit. In one development, the shunt conducts sheet-shaped material to the first transfer printing transport path and the second transfer printing transfer path in alternation. Since each printing unit prints the sheet-shaped material with the same transfer printing speed and two printing units are arranged in parallel, the printing output in the apparatus is doubled overall. Accordingly, single sheets can be supplied and in turn discharged with double the printing speed.

Another exemplary embodiment provides that the first transfer printing transport path and the second transfer printing transfer path are connected by a connecting channel through which sheet-shaped material can be conveyed in one or in both conveying directions. As a result of these measures, printed material can be supplied from the first printing unit to the second printing unit as well as from the second printing unit to the first printing unit in order to print it. The connecting channel thus results in the creation of a return that connects the two printing units to one another, as a result whereof many-faceted printing processes are enabled.

A further embodiment provides that the sheet-shaped material is turned over during transport from the first transfer printing transport path to the second transfer printing transport path. In this way, each printing unit can print the front side and, too, the back side of a single sheet. When developing stations with different colors are employed for the two printing units, then two image patterns with two different colors can be printed on each side of the single sheet, i.e. what is referred to as a two-color duplex mode, also called duplex color spot mode, can be realized.

Despite technical improvements at the printing units, damage and outage can never be completely precluded since these are in part caused by incorrect applications or operating errors. In order to then shorten the down times of a such a printing system, various device manufacturers for high-performance printers and copiers maintain a very quickly reacting service department with on-call service. The outlay for this service department is very high. In the present invention, it is then possible to considerably reduce the overall failure probability of the operation of such apparatus.

In an embodiment, the present invention provides a method for operating a printer or copier comprising the steps of supplying sheet-shaped material individually in succession through an input section to a first printing unit, printing an image pattern onto a sheet-shaped material with the first printing unit, sending the printed sheet-shaped material individually in succession from the first printing unit through an output section, supplying sheet-shaped material individually in succession through the input section to a second printing unit, printing an image onto the sheet-shaped material with the second printing unit, sending the printed sheet-shaped material individually in succession from the second printing unit through the output section, and in a simplex operating mode, alternating the supplying of sheet-shaped material to the first and second printing units by switching a first shunt disposed in the input section, and in a duplex operating mode, supplying printed sheet-shaped material, with printing disposed on a first side thereof, from the first printing unit through a first transfer printing transport path to a connecting channel to the second transfer printing transport path to the second printer for printing a second side of the printed sheet-shaped material, and in an emergency operating mode, wherein one of the first or second printing units is malfunctioning, shutting off the malfunctioning printing unit and switching the first shunt to supply sheet-shaped material only to the non-malfunctioning printing unit.

In an embodiment, in the simplex mode, the sheet-shaped material is supplied to the first printing unit only through the first transfer printing transport path and the sheet-shaped material is supplied to the second printing unit only through the second transfer printing transport path.

In an embodiment, in the condition with a malfunctioning first or second printing unit, the sheet-shaped material is supplied to the non-malfunctioning printing unit at an emergency conveying speed that is only half as fast as a normal operation conveying speed.

In an embodiment, the first transfer printing transport path and the second transfer printing transport path are connected by the common connecting channel and by a feeder channel to form a loop.

In an embodiment, the sheet-shaped material is conveyed in one or in both conveying directions in the connecting channel.

In an embodiment, the sheet-shaped material is turned over at an end of the connecting channel.

In an embodiment, in the duplex operating mode, during the conveying of the sheet-shaped material from the first transfer printing transport path to the second transfer printing transport path, the sheet-shaped material is turned over by a turn-over mechanism.

In an embodiment, the turn-over mechanism comprises a second shunt, and the sheet-shaped material is first conveyed past the second shunt on a first conveying path in a first conveying direction and, subsequently, the conveying direction is reversed to a second conveying and in the second shunt conveys the sheet-shaped material to a second conveying path in the second conveying direction.

In an embodiment, in duplex printing mode, the sheet-shaped material is first supplied to the first transfer printing transport path before being printed by the first printing unit and is subsequently supplied to the second transfer printing transport path before being printed by the second printing unit, and after the sheet-shaped material printed by the second printing unit, the sheet-shaped material is turned over and re-supplied to the first transfer printing transport path for additional printing by the first printing unit, and the sheet-shaped material is supplied to the second transfer printing transport path without being turned over for additional printing by the second printing unit.

In an embodiment, in the first transfer printing transport path, the connecting channel and a feeder channel form a closed loop transport path, whereby the feeder channel can transport sheet-shaped material in both directions and supplies sheet-shaped material to the second transfer printing transport path for delivery to the second printing unit.

In an embodiment, in the second transfer printing transport path, the connecting channel and a discharge channel form a closed transport path, and wherein the discharge channel can convey sheet-shaped material in both directions and connects the first transfer printing transport path to the output section.

In an embodiment, a turn-over mechanism is provided that turns the sheet-shaped material over before being deposited is downstream of the output section as viewed in a conveying direction of the sheet-shaped material.

In an embodiment, the first shunt is disposed downstream of the input section and a second shunt is disposed at a junction between the first transfer printing transport path and the connecting channel and the discharge channel, and a third shunt is disposed at a junction between the connecting channel, the second transfer printing transport path and the feeder channel, and a fourth shunt is disposed at a junction between the second transfer printing transport path and the discharge channel.

In an embodiment, the present invention provides a method for operating a printer or copier comprising a supplying of sheet-shaped material individually in succession through an input section to a first printing unit, a printing of an image pattern onto a sheet-shaped material with the first printing unit, a sending of the printed sheet-shaped material individually in succession from the first printing unit through an output section, a supplying of sheet-shaped material individually in succession through the input section to a second printing unit, a printing of an image onto the sheet-shaped material with the second printing unit, a sending of the printed sheet-shaped material individually in succession from the second printing unit through the output section, and in a simplex operating mode, alternating the supplying of sheet-shaped material to the first and second printing units by switching a first shunt disposed in the input section, and in a first duplex operating mode wherein sheet-shaped material that was printed on one side thereof by one of the first and second printing units is turned over and re-supplied to the same printing unit for printing on an opposite side thereof.

In an embodiment, the present invention provides a printer or copier comprising a first printing unit that prints an image pattern onto a sheet-shaped material and to which sheet-shaped material is individually successively supplied via an input section, the first printing unit being in communication with an output section through which the printed material is individually output in succession, a second printing that prints an image pattern onto a sheet-shaped material and to which sheet-shaped material is individually successively supplied via an input section unit and from which printed sheet-shaped material is output through said output section, the printer or copier capable of being switched between the following modes: a first simplex operating mode with increased throughput of sheet-shaped material wherein sheet-shaped material for printing is supplied to the first and second printing units in alternation, and a first duplex operating mode wherein the sheet-shaped material that was printed on one side by one of the first and second printing units is re-supplied to the same printing unit for printing on a back side thereof.

In an embodiment, the printer further comprises a first transfer printing transport path connecting the first printing unit to the input section and a separate, second transfer printing transport path for connecting the second printing unit to the input section, and a discharge channel through which sheet-shaped material that was printed by the first printing unit can be supplied to the output section in the first simplex operating mode and, in the first duplex operating mode, sheet-shaped material that was printed on one side by the second printing unit can be re-supplied through the discharge channel to the second printing unit for printing on another side thereof.

In an embodiment, the sheet-shaped material in the discharge channel can be transported in two opposite directions dependent on the existing operating mode.

In an embodiment, the first and second transfer printing transport paths are connected by a connecting channel.

In an embodiment, the first transfer printing transport path and the second transfer printing transport path are connected by the connecting channel through which sheet-shaped material can be conveyed in two conveying directions.

Other objects and advantages of the present invention will become apparent from reading the following detailed description and appended claims, and upon reference to the accompanying drawings.

BRIEF DESCRIPTION OF THE DRAWING

Exemplary embodiments of the invention are explained below with reference to the drawing, wherein.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
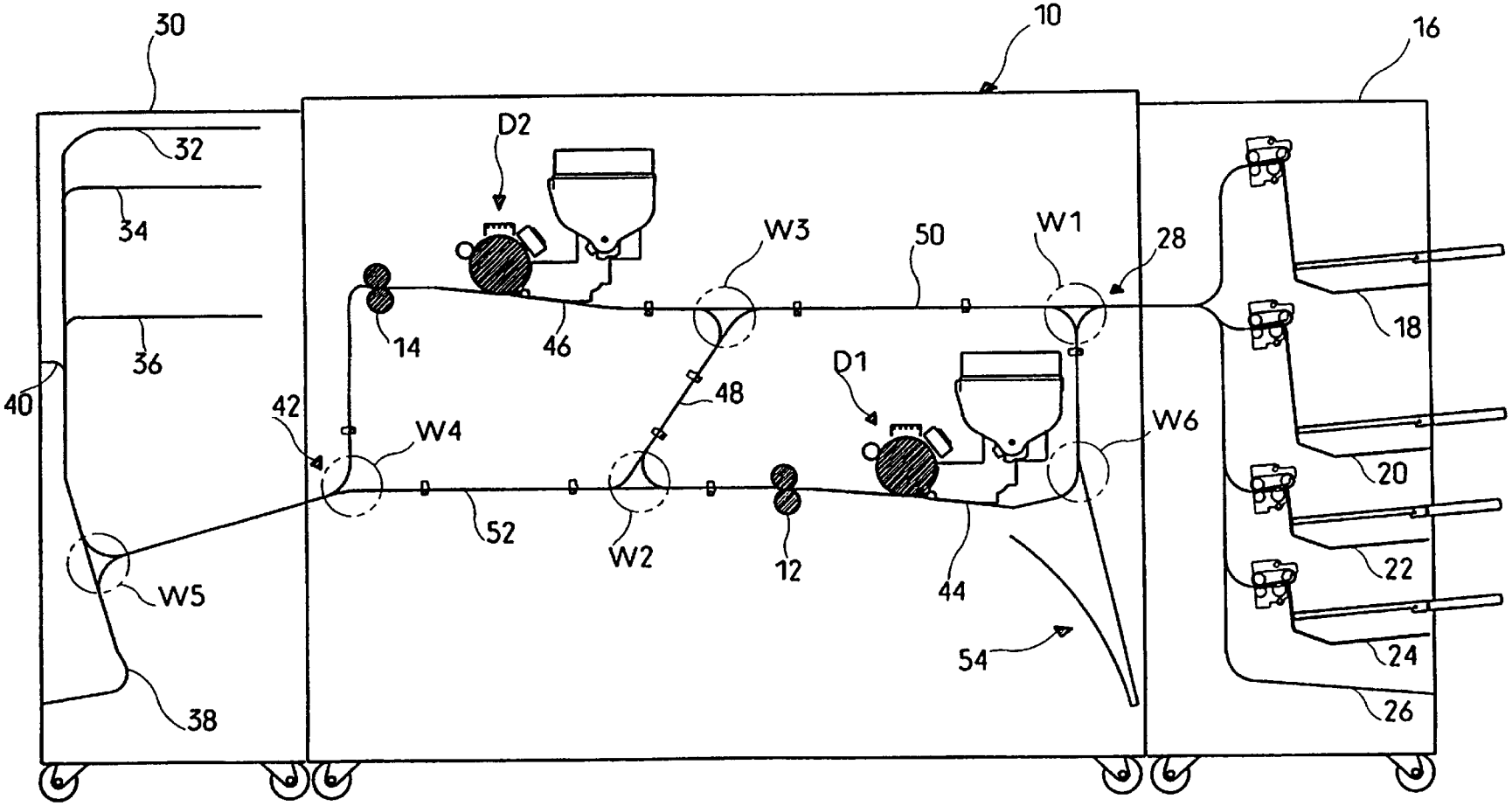
FIG. 1 is the schematic view of a structure of a high-performance printer wherein the invention is realized.

FIG. 1 shows a high-performance printer 10 that serves for fast printing of single sheets of paper. The high-performance printer 10 contains a first, lower printing unit D1 as well as a second, upper printing unit D2. Both printing units D1, D2 work according to the known electrographic process with the same transfer printing speed. The printing units D1, D2 are followed by fixing devices that are schematically indicated in FIG. 1 by two roller pairs 12, 14. A paper input 16 is connected to the high-performance printer 10, said paper input 16 containing a plurality of reservoirs 18 through 24 with single sheets as well as an external paper input channel 26 via which single sheets can be supplied from the outside. Single sheets are supplied to an input section 28 via a transport channel. At the output side, a paper output 30 that contains a plurality of output containers 32 through 36 is connected to the high-performance printer 10. Further, two output channels 38, 40 via which single sheets can be output to further-processing stations are provided. The high-performance printer 10 outputs the printed single sheets via the output section 42.

Transport paths for the transport of the single sheets are arranged in the inside of the high-performance printer 10, various operating modes of the high-performance printer being realized therewith. The printing units D1, D2 have respective transport paths 44, 46 allocated to them that are respectively set such by drives that the supplied single sheets have their transfer printing speed at the printing units D1, D2. The two transfer printing transport paths 44, 46 are connected to one another via a connecting channel 48. The transport path around the first printing unit D1 is augmented to form a ring by a feeder channel 50 via which single sheets can also be supplied from the input section 28 to the second transfer printing transport path 46. The transport path for the second printing unit D2 is augmented to form a ring in a similar way a discharge channel 52 via which the single sheets printed by the printing unit D1 can be supplied to the output section 42.

A first shunt W1 makes it possible that single sheets from the input section 28 are optionally supplied to the first transfer printing path 44 or to the feeder channel 50. The first shunt is arranged between the input section 28, the first transfer printing transport path 44 and the feeder channel 50. A further version is comprised therein that single sheets transported on the feeder channel 50 in the direction of the shunt W1 can be supplied to the first transfer printing transport path 44.

Further, a second shunt W2 and a third shunt W3 are arranged at the ends of the connecting channel 48 and respectively connect the adjoining transport paths 44, 48, 52 or, respectively, 46, 48, 50. A fourth shunt W4 is located in the proximity of the output section 42 and connects the adjoining transport paths. The paper output 30 contains a fifth shunt W5 that works as turnover means. Further, an ejection means 54 should also be pointed out, reject single sheets being supplied thereto via a shunt W6.

Various operating modes of the high-performance printer 10 can be realized by the arrangement described in FIG. 1. The various operating modes are schematically shown in the following FIGS. 2 through 7. The respective conveying of the single sheets is illustrated on the basis of arrows.

Figure 2:
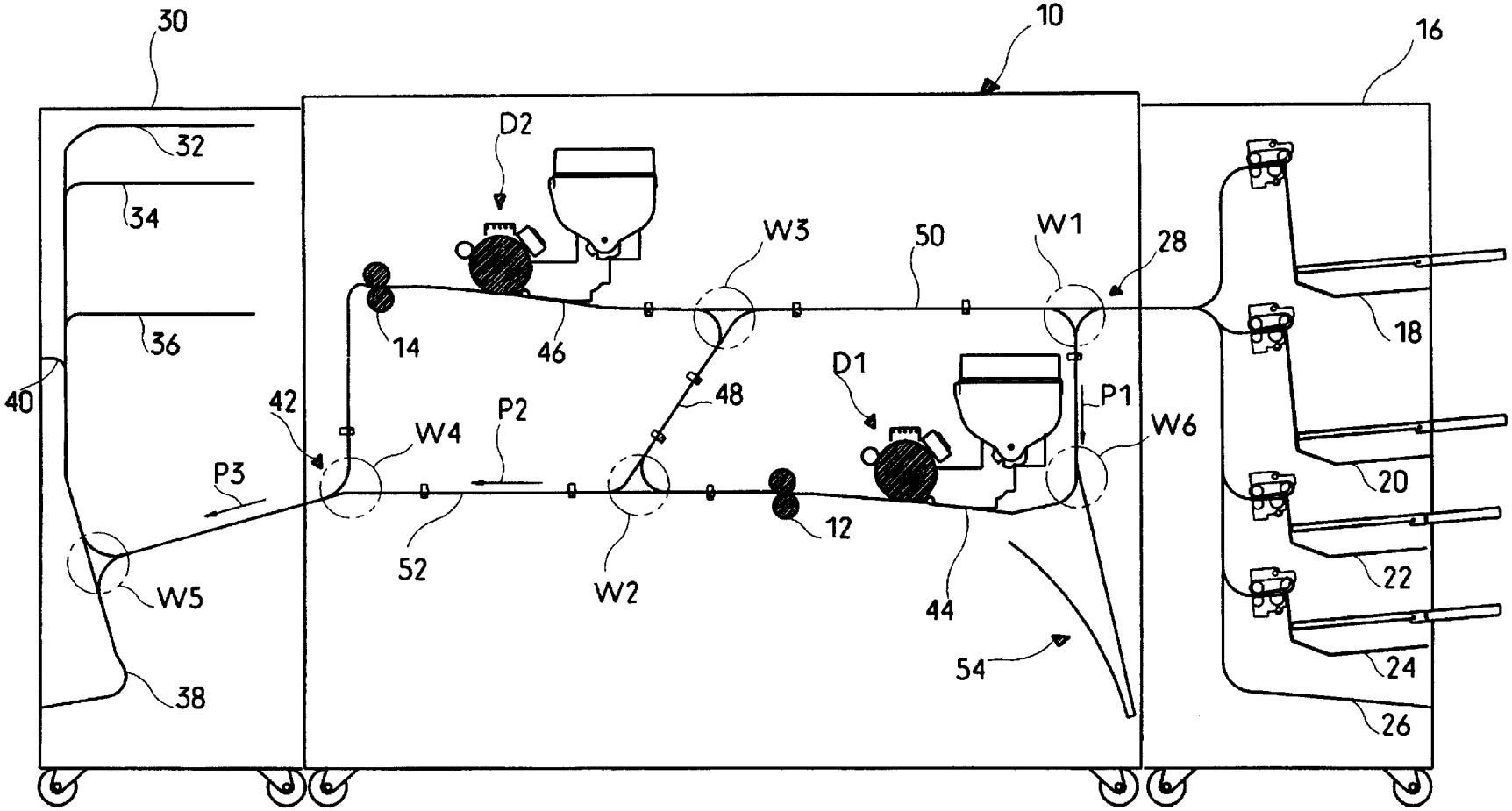
FIG. 2 illustrating the operating mode of simplex printing with the lower printing unit of the printer shown in FIG. 1.

FIG. 2 schematically shows simplex printing with only one printing unit. Only one side of a single sheet is printed in this simplex printing. The single sheet proceeds via the input section 28 and the correspondingly switched shunt W1 along the arrow P1 to the first transfer printing transport path 44 and is printed at the printing unit D1. Subsequently, the single sheet is output (arrow P3) into the paper output 30 along the discharge channel 52 (arrow P2) via the output section 42.

Figure 3:
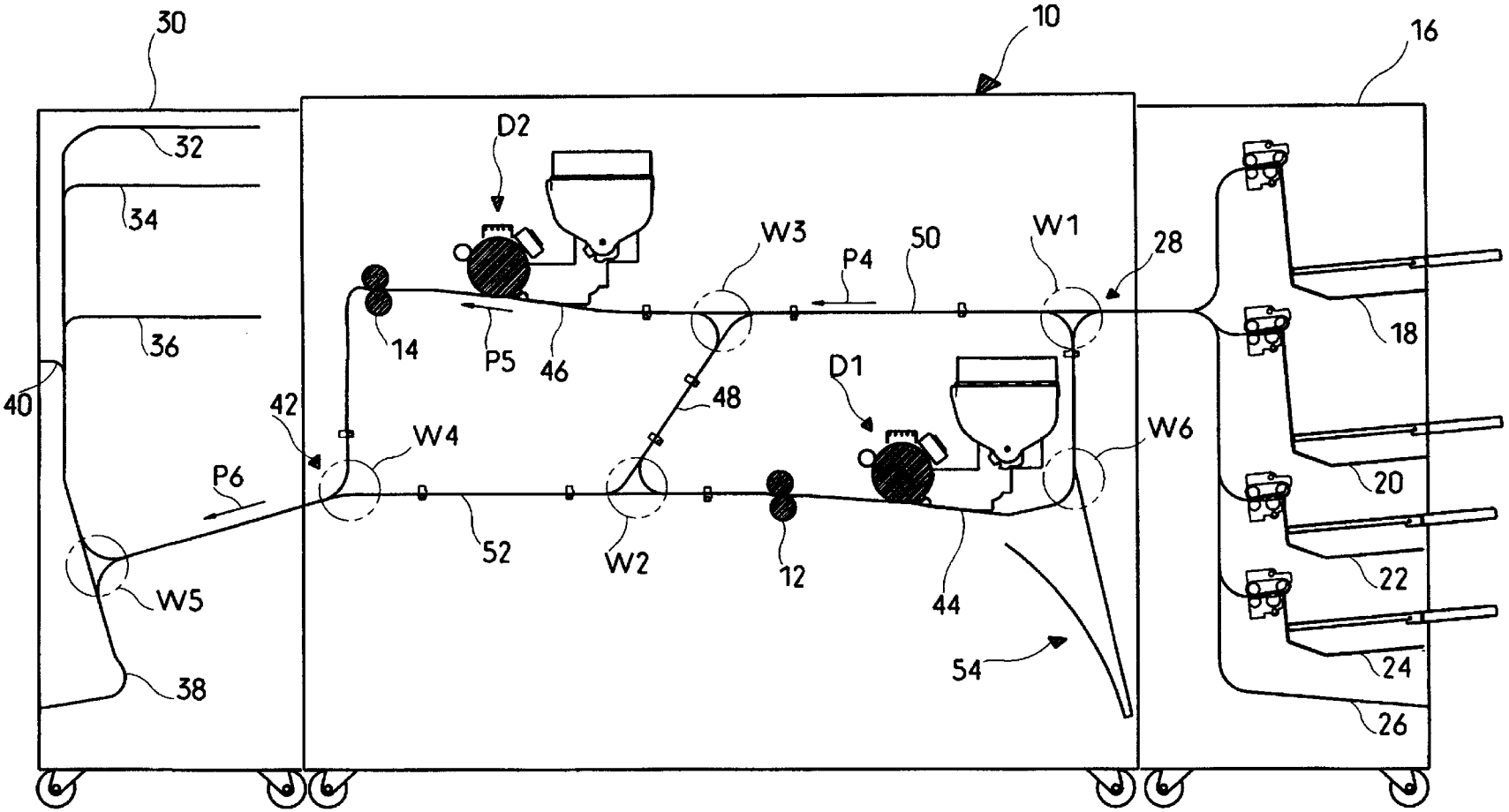
FIG. 3 illustrates the operating mode of simplex printing with the upper printing unit of the printer shown in FIG. 1.

FIG. 3 shows the simplex printing with the upper, second printing unit D2. The transport of the single sheet ensues via the feeder channel 50 (arrow P4), the second transfer printing transport path (arrow P5) to the paper output 30 (arrow P6).

Figure 4:
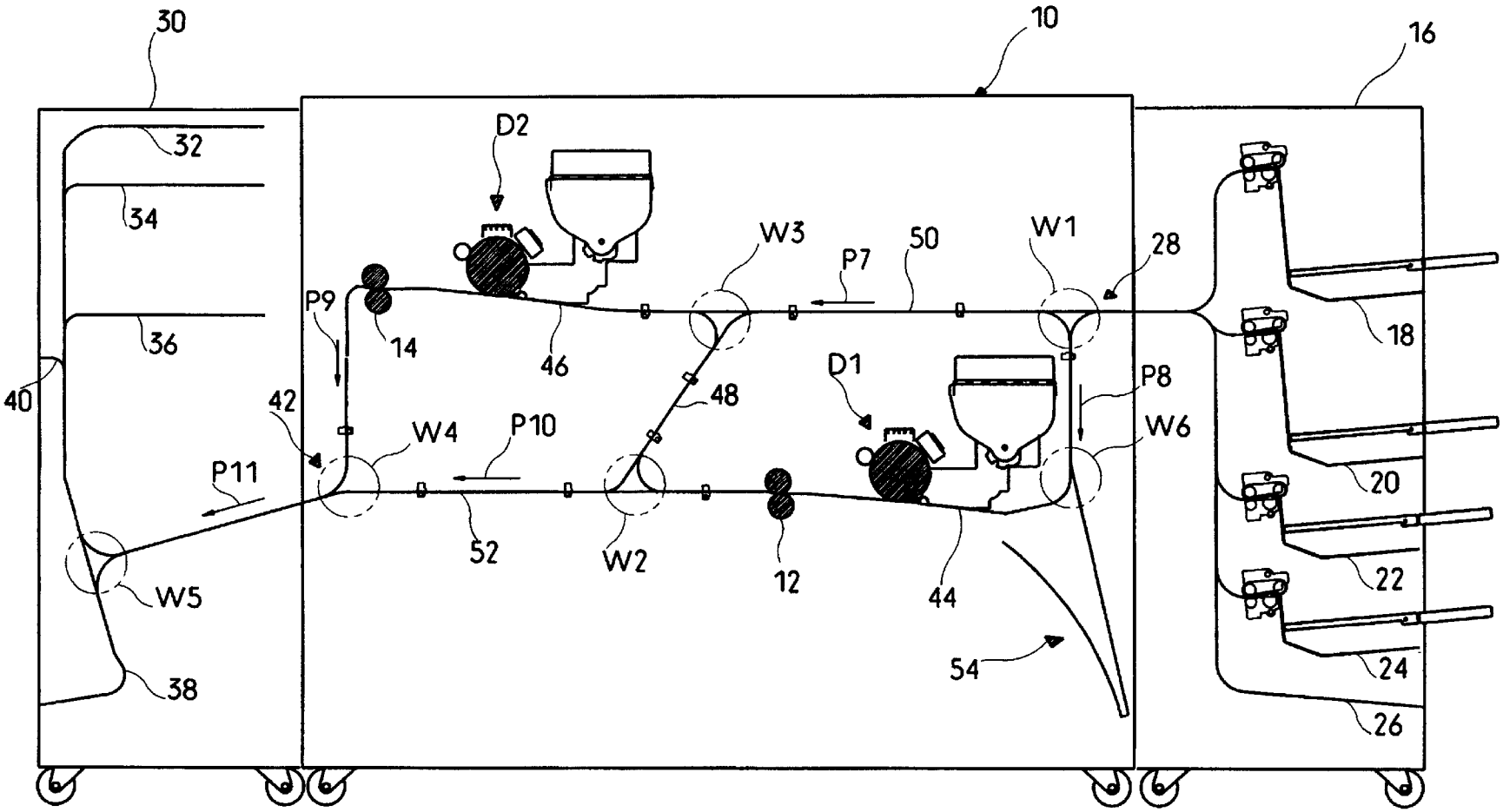
FIG. 4 illustrates the operating mode of alternating simplex printing of the printer shown in FIG. 1.

Given alternating simplex printing with enhanced printing output, single sheets are supplied to via the input section 28 with at least double the transfer printing speed of the printing units D1, D2. FIG. 4 schematically shows the transport of the single sheets. The shunt W1 supplies single sheets to the feeder channel 50 or, respectively, the first transfer printing transport path (arrows P7, P8) in alternation. While being transported to the printing units D1, D2, the single sheets are decelerated to transfer printing speed, are respectively printed on the front side thereat and are subsequently further-conveyed to the shunt W4. During this further-conveying according to the arrows P9, P10, the single sheets are accelerated to at least double the transfer printing speed, so that they are output at the common output section via the shunt W4 spaced from one another and can be successively further-conveyed in the paper output 30 according to the arrow P11 with at least double the transfer printing speed.

In what is referred to as the operating mode of "alternating simplex printing", thus, it is inventively provided that, in the paper input 16, the single sheets in the input section 28 are supplied to the printing units D1, D2 with at least double the transfer printing speed. In the paper output 30 as well, the single sheets are likewise further-conveyed and deposited with at least double the speed. As a result of this measure, the single sheets arrive at the common input section 28 and at the common output section 42 without the possibility of a collision of single sheets and, accordingly, a paper jam occurring. Preferably, the transport paths for the single sheets supplied to the first printing unit D1 and the single sheets supplied to the second printing unit D2 are symmetrically designed or are at least of equal length, so that the single sheets on both conveying paths can be decelerated and accelerated with the same speed profile. As a result thereof, it is possible to construct the drives and mechanisms required for the transport identically. Further, it is possible to employ identical controls.

Figure 5:
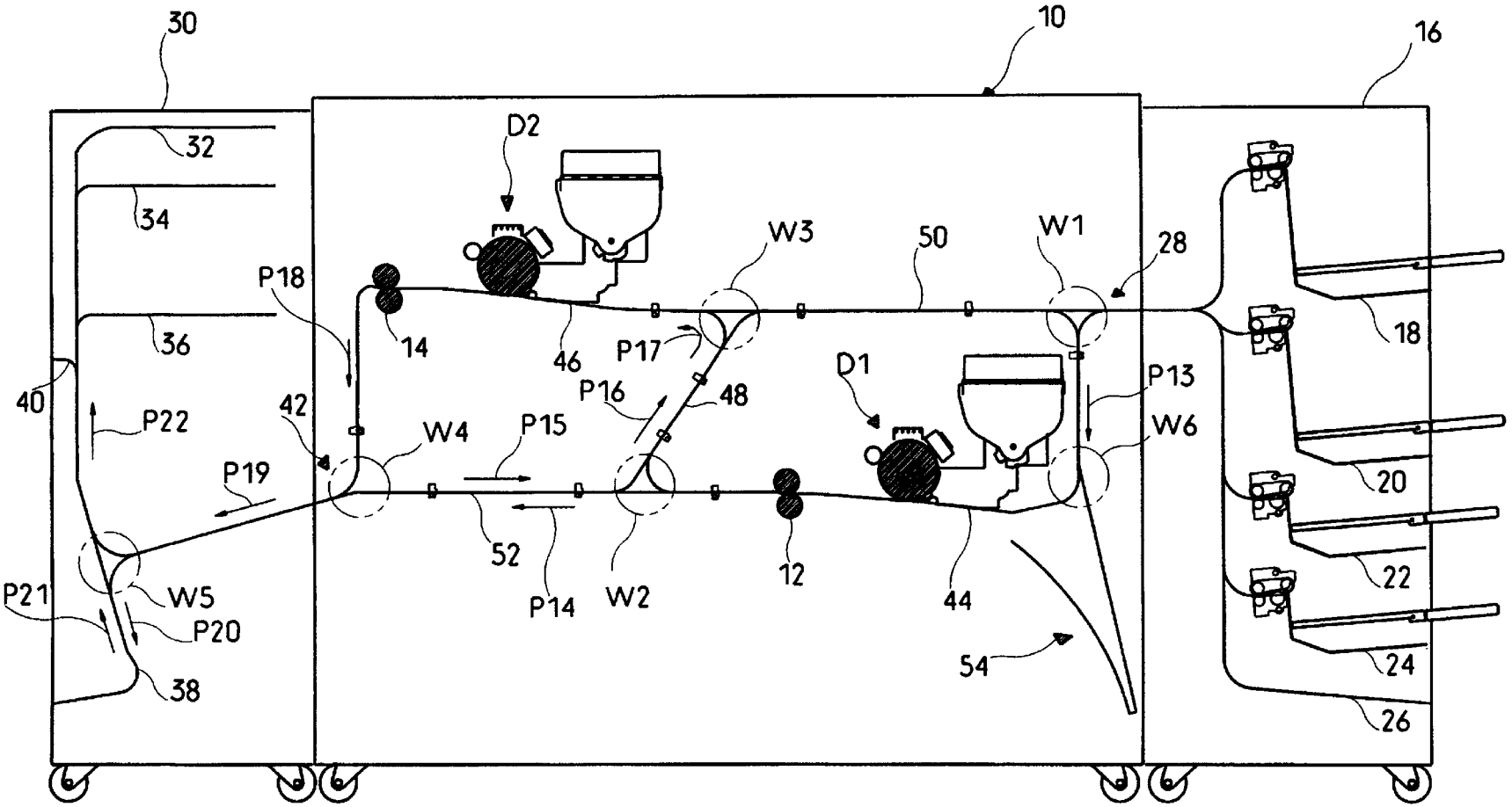
FIG. 5 illustrates the operating mode of duplex printing of the printer shown in FIG. 1.

FIG. 5 schematically shows the duplex printing mode wherein the single sheets are printed on both sides. The single sheets supplied to the input section 28 are supplied to the first transfer printing transport path 44 (arrow P13) by the first shunt W1. After being printed by the printing unit D1, the respective single sheet is conveyed out a turnover distance via the shunt W2 according to the arrow P14. This turnover distance is a part of the discharge channel 52. Subsequently, the conveying direction is reversed according to arrow P15, and the shunt W2 then conducts the single sheet into the connecting channel 48 according to the arrow P16. The single sheet is then steered to the second transfer printing transport path 46 by the shunt W3 in the direction of the arrow P17. The as yet unprinted backside of the single sheet is thus supplied to the printing unit D2 for printing. Subsequently, the single sheets are supplied according to the arrow P18 to the shunt W4 and are transported into the paper output 30 along the arrow P19. Since the single sheet is transported with its backside facing up in this condition, it must still be turned over before being deposited into the compartments 32 through 36. The shunt W5 serves this purpose. The single sheet is first conducted for a predetermined turnover distance in the direction of the arrow P20 by the shunt W5. The conveying direction is then reversed according to the arrow P21, and the shunt W5 conveys the single sheet in the direction of the arrow P22, whereupon it is deposited in the deposit compartments 32 through 36 with the proper side up.

As can be seen, the shunt W2 acts as turnover means in order to supply the backside of the single sheet to the printing unit D2. Alternatively, the shunt W3 can also be utilized for turning over. The single sheet leaving the printing unit D1 is then conducted in the direction of the shunt W1 via the shunt W2, the connecting channel 48 of the shunt W3 and then along the feeder channel 50 for a short turnover distance. Subsequently, the conveying direction is reversed and the shunt W3 conducts the single sheet in the direction of the printing unit D2 with its backside facing up.

Figure 6:
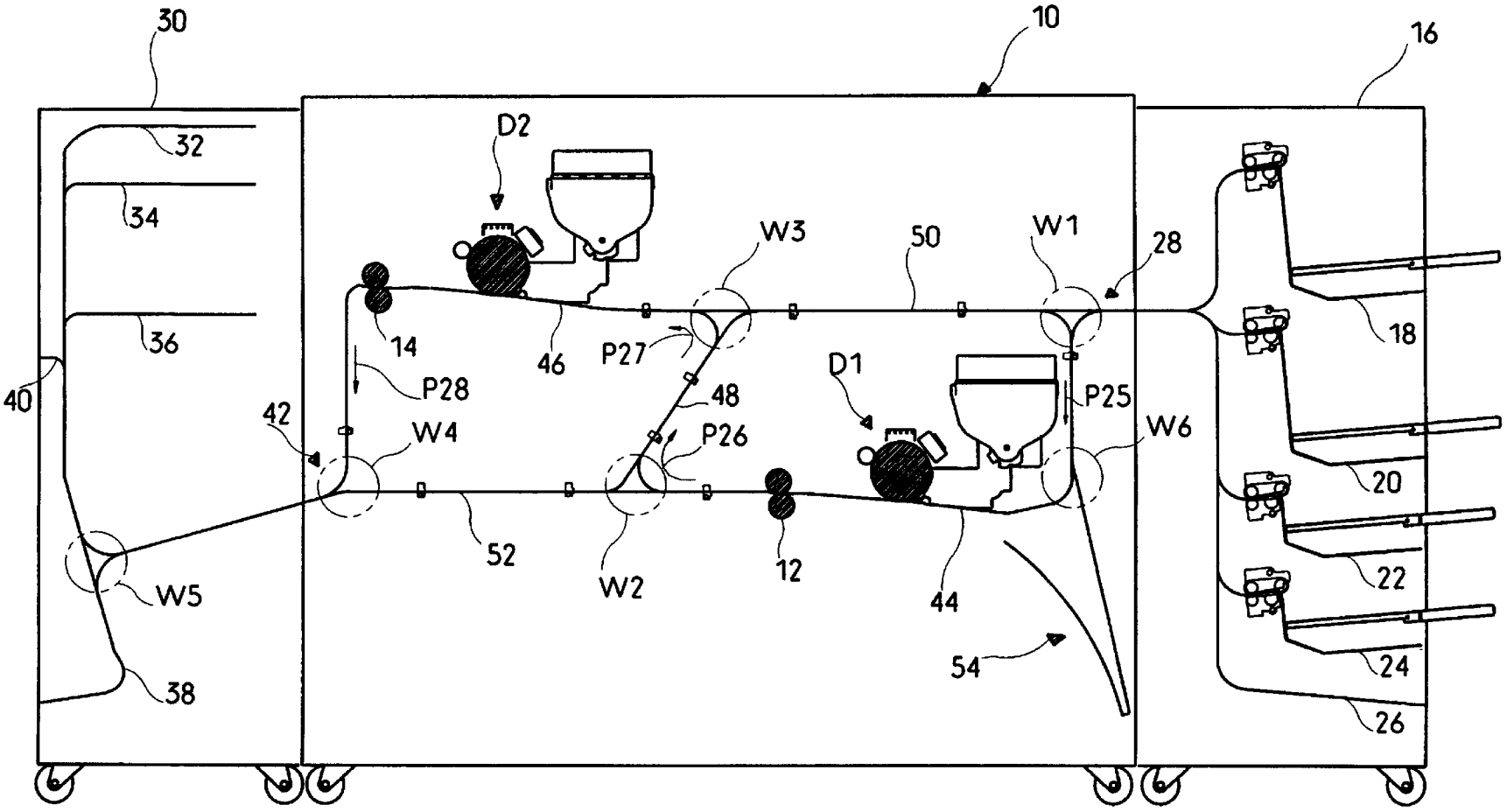
FIG. 6 illustrates the operating mode of two-color simplex printing of the printer shown in FIG. 1.

FIG. 6 schematically shows a further operating mode, the two-color simplex printing, wherein the front side of a single sheet is printed with two image patterns of different color. The two printing units D1, D2 print image patterns of different color. In said operating mode of two-color simplex printing, the single sheet is supplied to the printing unit D1 (arrow P25) via the shunt W1. Subsequently, the single sheet is supplied via the shunt W2 to the connecting channel 48 without being turned over and is then supplied to the printing unit D2 via the shunt W3 (arrows P26, P27). The printing unit D2 prints the front side with a color different from the color of the printing unit D1. Subsequently, the single sheet is output to the paper output 30 via the shunt W4 (arrow P28).

Figure 7:
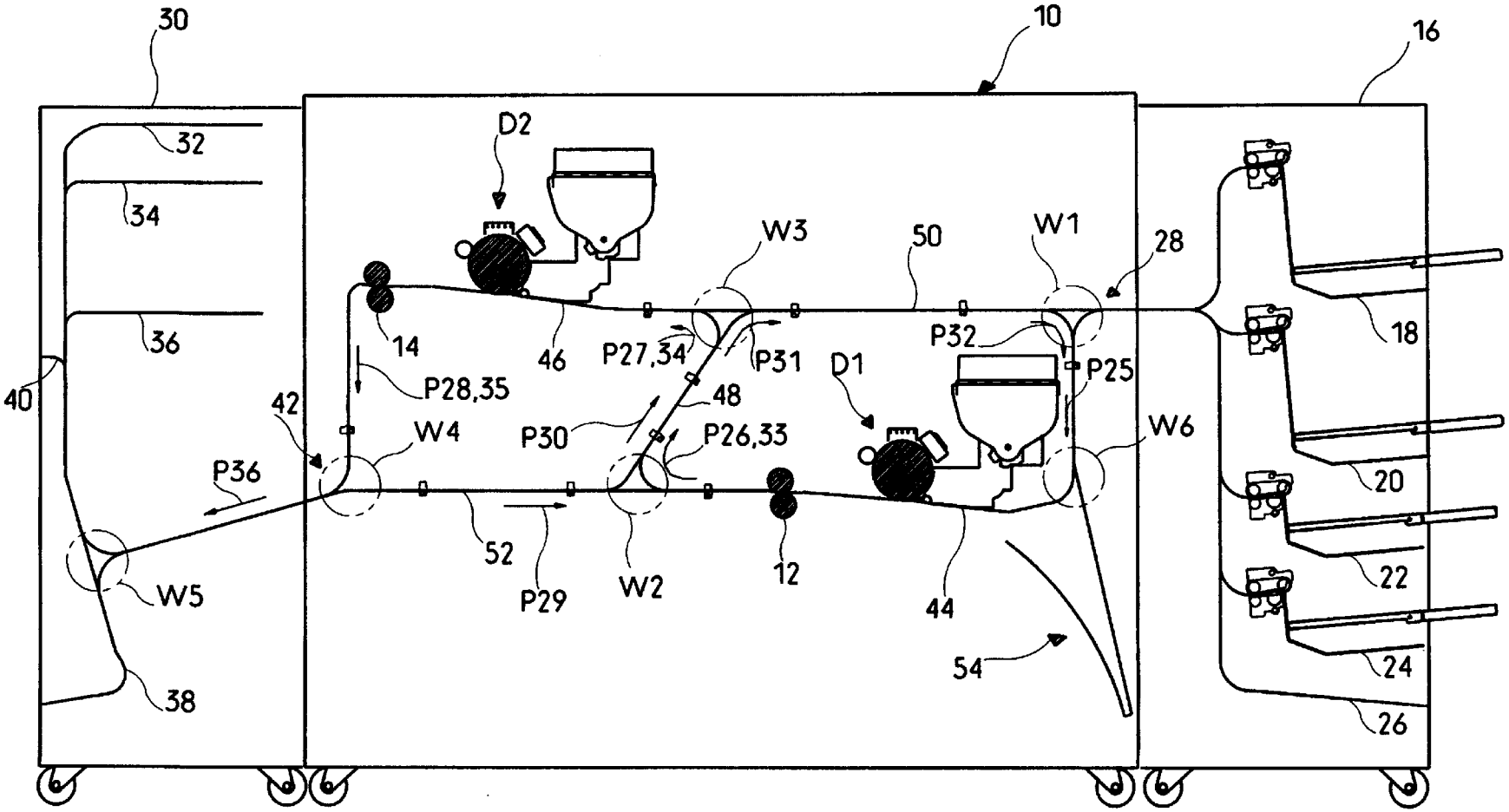
FIG. 7 illustrates the operating mode of two-color duplex printing of the printer shown in FIG. 1.

FIG. 7 schematically shows the conveying path of a single sheet in the operating mode of two-color duplex printing wherein the front side and the backside of a single sheet are printed with image patterns of different color. A precondition therefor is that the printing units D1 and D2 print differently colored print images. For two-color printing of the front side, one proceeds as in the operating mode of two-color simplex printing according to FIG. 6. The arrows P25, P26, P27 and P28 illustrate the conveying path. Subsequently, the single sheet is resupplied to the printing unit D1. The arrows P29 through P36 illustrate the conveying path of the single sheet for printing the backside. So that this backside is supplied to the printing unit D1, the single sheet must be turned over on the conveying path between the printing unit D2 and the printing unit D1. This turning can ensue, for example, at the shunt W4, the shunt W2 or at the shunt W3.

In a preferred exemplary embodiment of the invention, the turning ensues with the assistance of the shunt W4, i.e. the single sheet is first transported in the direction of the shunt W5 for a short turnover distance, the conveying direction is then reversed, and the single sheet is further conveyed in the direction of the shunt W2. After transport into the paper output 30 according to the arrow P36, a further turning ensues with the shunt W5 and the side-proper deposit of the single sheet printed double-sided with respect to the two color images subsequently ensues.

An alternative transport of the single sheet through the high-performance printer 10 for realizing the operating mode of two-color duplex printing can ensue in the following way. First, the single sheet is supplied from the input section 28 via the shunt W1 to the printing unit D1, its front side is printed and, subsequently, it is conducted via the shunts W2 and W3 for turn-over in the direction of a shunt W1 for a short distance. After passing the shunt W3, the conveying direction is modified in the direction of the printing unit D2, and the single sheet is conveyed on the transfer printing transport path 46. The shunt W3 thus serves as turn-over station. At the printing unit D2, accordingly, the backside of the single sheet is printed. Subsequently, the single sheet is resupplied to the first printing unit D1 via the shunts W4, W2, W3 and W1 in order to now print the backside. The single sheet must be turned over for this purpose. This ensues at the shunt W4, whereby it is briefly conveyed in the direction of the shunt W5, the conveying direction is reversed and it is conveyed in the direction of the shunt W2 in its turned-over condition. After printing the backside of the single sheet in the printing unit D1, the single sheet is supplied via the shunts W2 and W3 to the printing unit D2, whereby it is turned over. The front side is now printed by the printing unit D2. Subsequently, the single sheet is conducted to the deposit compartments 32 through 36 via the shunt W4. Since it now proceeds into the deposit 30 attitutendly correct, i.e. with the top side up, it need not be turned over again by the shunt W5.

As already mentioned above, a limited printing operation can be maintained with the high-performance printer 10 even given failure of a printing unit D1 or D2. In the operating mode of simplex printing (FIG. 2), the shunt W1 can be set such, for example, given outage of the printing unit D2, that it supplies single sheets only to the printing unit D1. The printing unit D2 is turned off and the second transfer printing transport path 46 is not used. The single sheets printed by the printing unit D1 are output to the paper output 30 via the shunt [sic] W2 and W4. In this operating condition, the high-performance printer 10 works only with half the conveying speed of the single sheets compared to non-malfunctioning operation.

If the first printing unit D1 fails in the operating mode of simplex printing, this is then shut off. The shunts W1 and W3 then conduct the single sheets via the feeder channel 50 and the second transfer printing transport path 46 to the second printing unit D2. Subsequently, the printed single sheets are output to the paper output 30 via the shunt W4.

A limited duplex printing mode can also be maintained in the operating mode of duplex printing with printing on front side and backside of the single sheets given failure of a printing unit D1 or D2. When, for example given a duplex mode (see FIG. 5), the upper, second printing unit D2 fails, then this is shut off. The single sheets continue to be supplied to the printing unit D1 via the shunt W1. Subsequently, the single sheets are conveyed in the direction of the fourth shunt W4 (arrow P14) via the second shunt W2. After passing the second shunt W2, the conveying direction (arrow P15) is reversed, and the single sheets are resupplied to the first printing unit D1 via the third shunt W3 and the first shunt W1. Due to the turn-over event by the reversal of conveying direction at the shunt W2, the backside is now printed by the first printing unit D1. Subsequently, the sheet-shape material is in turn output via the second shunt W2 and the fourth shunt W4.

When the first printing unit D1 malfunctions and the second printing unit D2 is still fully functional, then a duplex mode can nonetheless be maintained with the second printing unit D2 via the conveying paths 46, 52 and 48. The single sheets are supplied to the second printing unit D2 via the shunts W1 and W3. The printed single sheets are conducted for a short distance in the direction of the shunt W5 via the shunt W4. The conveying direction is reversed and the respective single sheet is conducted in the direction of the shunt W2. Due to the reversal of conveying direction at the shunt W4, the single sheet is turned over. Subsequently, the single sheet is resupplied to the printing unit D2 via the connecting channel 48 and the shunt W3 and the backside is now printed. Subsequently, the single sheet printed on both sides is output via the shunt W4 and is turned over as needed at the shunt W5 and subsequently deposited in one of the output containers 32 through 36.

Due to the disclosed redundancy operation given one malfunctioning and one fully functional printing unit, the function probability for the operation of the overall high-performance is enhanced. In practice, the user of the high-performance printer can continue to process his job despite a malfunctioning printing unit until the repair service that has been called has again brought both printing units into a functional condition.

From the above description, it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed is:

1. A method for operating a printer or copier comprising the following steps:

supplying sheet-shaped material individually in succession through an input section to a first printing unit;

printing an image pattern onto a sheet-shaped material with the first printing unit;

sending the printed sheet-shaped material individually in succession from the first printing unit through an output section;

supplying sheet-shaped material individually in succession through the input section to a second printing unit;

printing an image onto the sheet-shaped material with the second printing unit;

sending the printed sheet-shaped material individually in succession from the second printing unit through the output section; and in a simplex operating mode, alternating the supplying of sheet-shaped material to the first and second printing units by switching a first shunt disposed in the input section; and in a duplex operating mode, supplying printed sheet-shaped material, with printing disposed on a first side thereof, from the first printing unit through a first transfer printing transport path to a connecting channel to the second transfer printing transport path to the second printing unit for printing a second side of the printed sheet-shaped material; and in an emergency operating mode, wherein one of the first or second printing units is malfunctioning, shutting off the malfunctioning printing unit and switching the first shunt to supply sheet-shaped material only to the non-malfunctioning printing unit.

2. The method of claim 1 wherein, in the simplex operating mode, the sheet-shaped material is supplied to the first printing unit only through the first transfer printing transport path and the sheet-shaped material is supplied to the second printing unit only through the second transfer printing transport path.

3. The method of claim 1 wherein, in the condition with a malfunctioning first or second printing unit, the sheet-shaped material is supplied to the non-malfunctioning printing unit at an emergency conveying speed that is only half as fast as a normal operation conveying speed.

4. The method of claim 1 wherein the first transfer printing transport path and the second transfer printing transport path are connected by the common connecting channel and by a feeder channel to form a loop.

5. The method of claim 4 wherein the sheet-shaped material is conveyed in one or in both conveying directions in the connecting channel.

6. The method of claim 4 wherein the first transfer printing transport path, the connecting channel and a feeder channel form a closed loop transport path, whereby the feeder channel can transport sheet-shaped material in both directions and supplies sheet-shaped material to the second transfer printing transport path for delivery to the second printing unit.

7. The method of claim 6 wherein, in the second transfer printing transport path, the connecting channel and a discharge channel form a closed transport path, and wherein the discharge channel can convey sheet-shaped material in both directions and connects the first transfer printing transport path to the output section.

8. The method of claim 7 wherein the first shunt is disposed downstream of the input section and a second shunt is disposed at a junction between the first transfer printing transport path and the connecting channel and the discharge channel, and a third shunt is disposed at a junction between the connecting channel, the second transfer printing transport path and the feeder channel, and a fourth shunt is disposed at a junction between the second transfer printing transport path and the discharge channel.

9. The method of claim 1 wherein the sheet-shaped material is turned over at an end of the connecting channel.

10. The method of claim 1 wherein, in the duplex operating mode, during the conveying of the sheet-shaped material from the first transfer printing transport path to the second transfer printing transport path, the sheet-shaped material is turned over by a turn-over mechanism.

11. The method of claim 10 wherein the turn-over mechanism comprises a second shunt, and the sheet-shaped material is first conveyed past the second shunt on a first conveying path in a first conveying direction and, subsequently, the conveying direction is reversed to a second conveying direction and in the second shunt conveys the sheet-shaped material to a second conveying path in the second conveying direction.

12. The method of claim 1 wherein, in the duplex operating mode, the sheet-shaped material is first supplied to the first transfer printing transport path before being printed by the first printing unit and is subsequently supplied to the second transfer printing transport path before being printed by the second printing unit; and after the sheet-shaped material printed by the second printing unit, the sheet-shaped material is turned over and re-supplied to the first transfer printing transport path for additional printing by the first printing unit; and the sheet-shaped material is supplied to the second transfer printing transport path without being turned over for additional printing by the second printing unit.

13. The method of claim 1 wherein a turn-over mechanism is provided that turns the sheet-shaped material over before being deposited is downstream of the output section as viewed in a conveying direction of the sheet-shaped material.

14. A method for operating a printer or copier comprising the following steps:

supplying sheet-shaped material individually in succession through an input section to a first printing unit;

printing an image pattern onto a sheet-shaped material with the first printing unit;

sending the printed sheet-shaped material individually in succession from the first printing unit through an output section;

supplying sheet-shaped material individually in succession through the input section to a second printing unit;

printing an image onto the sheet-shaped material with the second printing unit;

sending the printed sheet-shaped material individually in succession from the second printing unit through the output section; and in a first simplex operating mode, alternating the supplying of sheet-shaped material to the first and second printing units by switching a first shunt disposed in the input section;

in a first duplex operating mode wherein sheet-shaped material that was printed on one side thereof by one of the first and second printing units is turned over and re-supplied to the same printing unit for printing on an opposite side thereof; and in a second duplex operating mode, the sheet-shaped material is conveyed from the input section to a first transfer printing transport path and then to the first printing unit, and after a front side of the material is printed by the first printing unit, the material is conveyed from the first printing unit to a connecting channel and then to a second transfer printing transport path and then to the second printing unit for printing on a back side of the material.

15. The method of claim 14 wherein the sheet-shaped material is supplied to the second printing unit via the same input section as the first printing unit.

16. The method of claim 14 wherein the sheet-shaped material is supplied to the first and second printing units through the first shunt disposed in the input section.

17. The method of claim 14 wherein, given a malfunction of one of the first or second printing units, the malfunctioning printing unit is shut off and the first shunt is switched to supply sheet-shaped material only to the non-malfunctioning printing unit.

18. The method of claim 14 further comprising a second simplex operating mode implemented given failure of one of the first or second printing units, in the second simplex operating mode, the sheet-shaped material is printed only by the other of the first or second printing units that is not mal-functioning and only on one side thereof.

19. The method of claim 14 wherein, in the first duplex operating mode for the second printing unit, the sheet-shaped material is transported through a discharge channel for printing the opposite side thereof by the second printing unit, the discharge channel being disposed parallel to the second transfer printing transport path of the second printing unit.

20. The method of claim 14 further comprising a third duplex operating mode wherein the sheet-shaped material is supplied from the input section to the first printing unit, is printed in a first color on one side thereof and is then supplied via the connecting channel to the second printing unit for printing said one side with a second color, the sheet is subsequently turned over and re-supplied to the first printing unit for printing a back side thereof in the first color and, finally, is re-supplied, without being turned over, to the second printing unit for printing the back side with the second color.

21. The method of claim 20 wherein the sheet-shaped material is turned over by a turnover mechanism during transport from the first transfer printing transport path to the second transfer printing transport path.

22. The method of claim 20 wherein two turnover mechanisms are provided opposing ends of the connecting channel.

23. The method of claim 20 wherein the sheet-shaped material coming from the first or from the second printing unit passes through a common output section spaced apart from other sheet-shaped material.

24. The method of claim 23 wherein the sheet-shaped material coming from the first printing unit and sheet-shaped material from the second printing unit is alternatingly output the common output section.

25. The method of claim 24 wherein the first transfer printing transport path of the first printing unit and the second transfer printing transport path of the second printing unit are connected via the connecting channel through which sheet-shaped material is conveyed in one or both conveying directions.

26. The method of claim 14 wherein the return of the sheet-shaped material from the second printing unit in one of the duplex operating modes is carried out through a discharge channel through which sheet-shaped material is supplied to the output section in the first simplex operating mode while bypassing the second transfer printing transport path of the second printing unit.

27. The method of claim 26 wherein, in the first simplex operating mode, the sheet-shaped material in the discharge channel is transported in a first direction, and in a duplex operating mode of the second printing unit, the sheet-shaped material is transported in a second direction opposite the first direction.

28. The method of claim 14 wherein in the first simplex operating mode, the sheet-shaped material is supplied to the first printing unit only via the first transfer printing transport path and the sheet-shaped material is supplied to the second printing unit only via the second transfer printing transport path.

29. The method of claim 14 wherein the sheet-shaped material is turned over by a turnover mechanism during transport from the first transfer printing transport path to the second transfer printing transport path.

30. A printer or copier comprising:

a first printing unit that prints an image pattern onto a sheet-shaped material and to which sheet-shaped material is individually successively supplied via an input section, the first printing unit being in communication with an output section through which the printed material is individually output in succession, a second printing unit that prints an image pattern onto a sheet-shaped material and to which sheet-shaped material is individually successively supplied via an input section unit and from which printed sheet-shaped material is output through said output section, the printer or copier capable of being switched between the following modes:

a first simplex operating mode with increased throughput of sheet-shaped material wherein sheet-shaped material for printing is supplied to the first and second printing units in alternation, a first duplex operating mode wherein the sheet-shaped material that was printed on one side by one of the first and second printing units is re-supplied to the same printing unit for printing on a back side thereof; and a second duplex operating mode wherein the sheet-shaped material is conveyed from the input section to a first transfer printing transport path and then to the first printing unit, and after a front side of the material is printed by the first printing unit, the material is conveyed from the first printing unit to a connecting channel and then to a second transfer printing transport path and then to the second printing unit for printing on a back side of the material.

31. The printer or copier of claim 30 further comprising a discharge channel through which sheet-shaped material that was printed by the first printing unit can be supplied to the output section in the first simplex operating mode and, in the first duplex operating mode, sheet-shaped material that was printed on one side by the second printing unit can be re-supplied through the discharge channel to the second printing unit for printing on another side thereof.

32. The printer or copier of claim 31 wherein the sheet-shaped material in the discharge channel can be transported in two opposite directions dependent on the existing operating mode.

33. The printer or copier of claim 32 wherein the first and second transfer printing transport paths are connected by a connecting channel.

34. The printer or copier of claim 33 wherein the first transfer printing transport path and the second transfer printing transport path are connected by the connecting channel through which sheet-shaped material can be conveyed in two conveying directions.

35. A printer or copier comprising:

a first printing unit that prints an image pattern onto a sheet-shaped material and to which sheet-shaped material is individually successively supplied via an input section, the first printing unit being in communication with an output section through which the printed material is individually output in succession, a second printing unit that prints an image pattern onto a sheet-shaped material and to which sheet-shaped material is individually successively supplied via an input section unit and from which printed sheet-shaped material is output through said output section, a first transfer printing transport path connecting the first printing unit to the input section and a separate, second transfer printing transport path for connecting the second printing unit to the input section, and a discharge channel through which sheet-shaped material that was printed by the first printing unit can be supplied to the output section in a first simplex operating mode and, in a first duplex operating mode, sheet-shaped material that was printed on one side by the second printing unit can be re-supplied through the discharge channel to the second printing unit for printing on another side thereof, and wherein the sheet-shaped material in the discharge channel can be transported in two opposite directions dependent on the existing operating mode, the printer or copier capable of being switched between the following modes:

the first simplex operating mode with increased throughput of sheet-shaped material wherein sheet-shaped material for printing is supplied to the first and second printing units in alternation, and the first duplex operating mode wherein the sheet-shaped material that was printed on one side by one of the first and second printing units is re-supplied to the same printing unit for printing on a back side thereof, and wherein the first and second transfer printing transport paths are connected by a connecting channel.

36. The printer or copier of claim 35 wherein the first transfer printing transport path and the second transfer printing transport path are connected by the connecting channel through which sheet-shaped material can be conveyed in two conveying directions.

* * * * *